US005165386A

United States Patent [19]

Van Der Veen

[11] Patent Number: 5,165,386

[45] Date of Patent: Nov. 24, 1992

[54] COMPACT GAS-FIRED AIR HEATER

[75] Inventor: Geuko Van Der Veen, Deventer, Netherlands

[73] Assignee: Veg-Gasinstituut N.V., Apeldoorn, Netherlands

[21] Appl. No.: 770,974

[22] Filed: Oct. 1, 1991

[30] Foreign Application Priority Data

Oct. 3, 1990 [NL] Netherlands ..... 9002150

[51] Int. Cl.[5] ..... F24H 3/02

[52] U.S. Cl. ..... 126/110 B; 126/116 R; 126/109

[58] Field of Search ..... 126/110 B, 99 R, 99 A, 126/99 C, 109, 110 R, 118, 116 A, 116 R; 431/353, 9; 432/222

[56] References Cited

U.S. PATENT DOCUMENTS

| | | | |
|---|---|---|---|
| 2,504,315 | 4/1950 | Feuerfile | 126/110 R |
| 3,741,166 | 6/1973 | Bailey | 431/9 X |
| 4,860,725 | 8/1989 | Tallman et al. | 126/110 R |
| 5,044,353 | 9/1991 | Mizuno et al. | 126/91 A |

FOREIGN PATENT DOCUMENTS 0347797 12/1989 European Pat. Off. .

OTHER PUBLICATIONS

Japanese Patent Abstract, vol. 9, No. 307 (M-535) (2030), Dec. 4, 1985 and JP-A-60 142 155 (Matsushita Denki Sangyo K.K.).

*Primary Examiner*—Larry Jones

*Attorney, Agent, or Firm*—Weingarten, Schurgin, Gagnebin & Hayes

[57] ABSTRACT

A heat exchanger for heating air or another gas, comprising at least one gas-fired burner comprising a metal pipe-shaped combustion chamber which is part of the heat exchanger and extends in the path of the air to be heated, wherein the pipe-shaped burner chamber (4) comprises means for enlarging the heat transfer surface, such as fins (V), with the pipe-shaped burner chamber (4) forming the first pass of at least two parallel passes which communicate at their ends via deflecting boxes (5, 6) and the burner (1) being a high-speed burner.

3 Claims, 1 Drawing Sheet

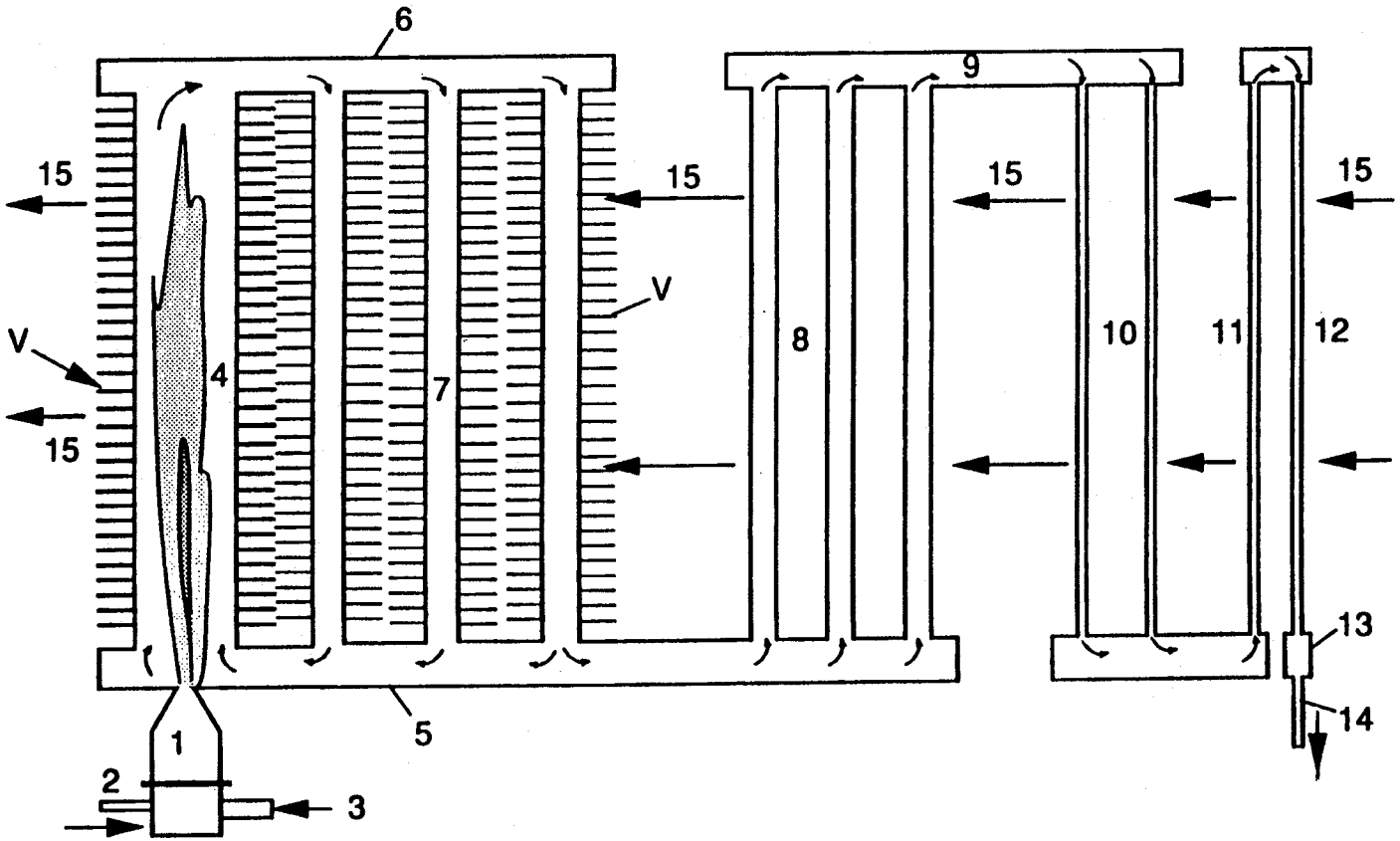
15
12
13
14
11
10
15
9
8
15
V
7
6
5
3
4
1
2
15
V
15

COMPACT GAS-FIRED AIR HEATER

FIELD OF THE INVENTION

This invention relates to a heat exchanger for heating air or another gas, comprising at least one gas-fired burner comprising a metal pipe-shaped combustion chamber which is part of the heat exchanger and extends in the path of the air to be heated.

The invention relates in particular to an air heater which is suitable for heating process air in ovens and driers using temperatures of up to about 400° C., in which the mixture of burnt gases and process air is not permissible.

BACKGROUND OF THE INVENTION

A problem to be taken account of in such heat exchangers, especially those of compact design, is that the temperature of the burnt gases is high relative to the intended final temperature of the process air to be heated and that gas-to-gas heat transfer is poor, at least slow.

Known solutions to these problems comprise the use of expensive refractory materials for the pipe-shaped combustion chamber and/or firing the burner with a large air excess in order to lower the flame temperature. The former solution has the disadvantage of a high cost price and the latter solution leads to poor thermal efficiency and high flue losses. Improving efficiency by preheating the combustion air has the disadvantage of increased $NO_x$ production.

The object of this invention is to provide a heat exchanger for heating air or another gas, in which the above-mentioned disadvantages are overcome.

SUMMARY OF THE INVENTION

To that end, in the heat exchanger according to the invention the pipe-shaped burner chamber comprises means for enlarging the heat transfer surface, such as fins, with the pipe-shaped burner chamber forming the first pass of at least two parallel passes which communicate at their ends via deflecting boxes and the burner being a high-speed burner.

In the heat exchanger according to the invention, the burner chamber pipe can be made of simple stainless steel. The gas-air mixture injected into the burner chamber pipe by the high-speed burner produces a reduced pressure at the beginning of the chamber, so that a part of the gases that have already cooled are recirculated from the second pass into the burner chamber, it being thereby accomplished that the flame temperature is limited to 1,100°–1,200° C. and the $NO_x$ content is low. At the same time, the heat distribution across the heat transfer surfaces is improved owing to the large burnt-gas volume that is circulated through the passes.

For efficiently lowering the gas temperature in the second and any further passes, the stream of air to be heated is preferably directed in counterflow, i.e. from the higher-number to the lower-number passes.

Further, according to the invention, the pipes of the second pass may also comprise fins for increasing the heat transfer surface.

To improve heat transfer efficiency, both in the first and in the second pass, more fins may be provided than is necessary on the basis of the difference in heat transfer. It is thus accomplished that the pipe wall temperature will be closer to the temperature of the air than to the temperature of the combustion gas.

By providing cooling fins on the pipes of the burner chamber and of the second pass, the temperature of the pipe wall can be lowered such that even in the case of a process air temperature of about 450° C. and a lesser pressure drop of the process air across the air heater, the pipes of the combustion chamber and the second pass can be made of simple types of stainless steel.

In further elaboration of the invention, a plurality of passes can be provided, arranged parallel relative to the first two passes but connected in series and terminating in a flue. Thus, the air flowing over these passes in counterflow is heated gradually by a comparatively slight heat transfer in each pass.

By forming the successive passes from pipes decreasing in number and/or section with each pass, the decrease of the flue gas volume as a result of cooling is compensated and the speed of the flue gas in the pipes remains sufficiently high to ensure good heat transfer even if the design is compact.

The pipes of the third and further passes may also be provided with cooling fins, but this is less relevant because the risk of exceeding the maximum permissible wall temperature is small there.

It is observed that as such a heat exchanger for heating air by radiation is known, comprising a high-speed burner and a pipe-shaped combustion chamber which at its ends communicates with a pipe-shaped second flue gas pass for recirculation of burnt gas. However, there the second pass is arranged concentrically around the burner chamber and both are made of material resistant to high temperatures, which are appropriate for heat transmission by radiation.

BRIEF DESCRIPTION OF THE DRAWINGS

To clarify the invention, one embodiment of the compact gas-fired air heater will now be described, by way of example, with reference to the accompanying drawing showing the invention in section.

DESCRIPTION OF THE PREFERRED EMBODIMENT

According to the drawing, which is a schematic longitudinal section of the heat exchanger for heating process air, the air heater comprises a high-speed burner 1 with a supply 2 for gas and a supply 3 for combustion air. The burner 1 is mounted at some distance before a pipe-shaped burner chamber 4. The burner chamber 4 comprises deflecting boxes 5 and 6 between which also extend pipes 7 of the second pass, so that at their ends these are in open communication with the burner chamber 1.

In the embodiment shown, the pipes of both the first and the second pass are provided with cooling fins increasing the external heat transfer surface.

The dimensions of the burner head 1, of the burner chamber 4 and the dimensions and/or the number of pipes 7 of the second pass determine the extent of recirculation of the burnt gas.

A burner head 1 with a wing nozzle having a diameter of 35 mm, a burner chamber 4 having a length of 600 mm and a diameter of 100 mm, a second pass consisting of 20 pipes 7 of the same length as the burner chamber and having a diameter of 23 mm, give good results with a burner capacity of about 120 kW. The deflecting boxes are internally lined with refractory insulating plate.

Via the deflecting box 5 adjacent the burner 1, the burnt gases can escape to a third pass 8 consisting of 20 finned pipes having a length of 600 mm and a diameter of 15 mm. Via a deflecting box 9, these gases can then reach a fourth pass 10, consisting of 16 pipes of the same dimensions and, thereafter, a fifth pass 11 and a sixth pass 12, both consisting of 12 pipes likewise having a length of 600 mm and a diameter of 15 mm.

In practice, only two deflecting boxes may be provided, in which the communication between the different passes has been set by means of partitions.

The last pass communicates with a flue 14 via flue gas collecting box 13.

The direction of flow of the process air to be heated is indicated by the arrows 15.

What I claim is:

1. A heat exchanger for heating air or another gas, comprising:

at least one gas-fired, high-speed, burner for heating a burner gas;

a heat transfer structure comprising:

at least one set of parallel flue passages, the flue passages of each set having successively smaller cross-sectional areas from set-to-set in order to maintain a desired speed and volume of said burner gas as it cools, each of said parallel flue passages comprising a plurality of finned pipes extending into an airway for a counterflow of air to be heated, wherein said heat transfer structure transfers thermal energy from said heated burner gas to said counterflow of air in said airway;

a metal pipe-shaped combustion chamber forming a flame passage ahead of said at least one set of parallel flue passages in communication with a first of said at least one set of parallel flue passages of said heat transfer structure by way of first and second deflecting boxes (6,5), said first deflecting box (6) forming a gas conduit for said burner gas to circulate from said flame passage to said first set of parallel flue passages, and said second deflecting box (5) forming a gas conduit with first and second outlets for said burner gas to recirculate back through said flame passage at said first outlet after passing through said first set of parallel flue passages and to proceed toward an exhaust flue (13, 14).

2. A heat exchanger according to claim 1, wherein said plurality of finned pipes has more fins than is necessary on the basis of the difference in heat transfer.

3. A heat exchanger according to claim 1, further comprising a second set of parallel flue passages ahead of said exhaust flue and, arranged across said airway and parallel to said flame passage and said first set of parallel flue passages (4, 7) and having a conduit connected to said second outlet of said second deflecting box (5).

* * * * *